US007914401B2

(12) United States Patent
Hulbert

(10) Patent No.: US 7,914,401 B2
(45) Date of Patent: Mar. 29, 2011

(54) GOALPOST UPRIGHT VERTICALITY ADJUSTMENT SYSTEM AND METHOD

(75) Inventor: Eric Hulbert, Walton, NY (US)

(73) Assignee: Sportsfield Specialties, Inc., Delhi, NY (US)

( * ) Notice: Subject to any disclaimer, the term of this patent is extended or adjusted under 35 U.S.C. 154(b) by 894 days.

(21) Appl. No.: 11/614,555

(22) Filed: Dec. 21, 2006

(65) Prior Publication Data

US 2007/0082765 A1 Apr. 12, 2007

Related U.S. Application Data

(60) Provisional application No. 60/789,203, filed on Apr. 4, 2006.

(51) Int. Cl.
*A63B 63/00* (2006.01)

(52) U.S. Cl. ..... 473/477; 473/470; 473/476; 473/439

(58) Field of Classification Search ..... 273/317, 273/317.5, 400, 407, 343, 354; 473/420, 473/421, 422, 470–474, 476–478, 439, 438; 40/607; 182/228.4, 228.6
See application file for complete search history.

(56) References Cited

U.S. PATENT DOCUMENTS 648,512 A * 5/1900 Manley ..... 473/477
895,297 A * 8/1908 Peter ..... 256/22
RE21,182 E * 8/1939 Baxter ..... 256/13.1
2,927,513 A * 3/1960 Dove ..... 256/13.1
3,058,777 A * 10/1962 Froedge ..... 297/440.24
3,284,054 A * 11/1966 St. Pierre ..... 256/13.1
3,353,852 A * 11/1967 Wood ..... 403/189
D212,372 S * 10/1968 Trimble ..... D21/699
3,675,922 A * 7/1972 Nieland ..... 473/420
5,261,647 A * 11/1993 Venegas et al. ..... 256/13.1
5,429,350 A 7/1995 Meier
6,394,917 B1 5/2002 Chiappini et al.
D500,105 S * 12/2004 Szaroletta et al. ..... D21/699
7,014,578 B1 * 3/2006 Brodeur ..... 473/477

OTHER PUBLICATIONS webpage download, Sportsfield webpage, 2004, http://web.archive.org/web/20040918052857/www.sportsfieldspecialties.com/goa14300.htm, 2 pages.*
Goal 4200-4280 Adjustable College/High School Football Goal Posts (6 pages).
Sports Supply Group Inc. Football Goal Post #1037210 (6 pages).
Sportsfield's "Construction products for state-of-the-art athletic fields and running tracks" (15 pages).

* cited by examiner

*Primary Examiner* — Alvin A Hunter
*Assistant Examiner* — M Chambers
(74) *Attorney, Agent, or Firm* — Heslin Rothenberg Farley & Mesiti P.C.

(57) ABSTRACT

Rotatable sleeves are disposed adjacent the ends of the crossbar of a goalpost. A stub is integrally formed with each of the sleeves and each stub protrudes through an opening in the crossbar. The opening in the crossbar is dimensioned to permit back to front movement of the stub and corresponding rotation of the sleeve until verticality of the stub and its associated upright is achieved. At that point, the sleeve is locked against further rotation by means of a tapping block previously installed in the sleeve and engaged with a serrated bolt through an appropriately dimensioned opening in the crossbar and corresponding holes in the sleeve. Once the bolts are tightened into the tapping block, the sleeve is drawn tightly against the interior surface of the crossbar, thereby locking the sleeve and the stub and the upright against further rotation.

14 Claims, 3 Drawing Sheets

GOALPOST UPRIGHT VERTICALITY ADJUSTMENT SYSTEM AND METHOD

CROSS-REFERENCE TO RELATED APPLICATIONS

This application claims priority based upon Provisional Patent Application Ser. No. 60/789,203 filed on Apr. 4, 2006.

TECHNICAL FIELD

This invention relates to goalposts such as are used in the game of football and, more particularly, to an improved system and method for establishing and maintaining true verticality of the uprights of such goalposts.

BACKGROUND OF THE INVENTION

Over the years, goalposts have been constructed in various ways and from different materials. Wooden goalposts were commonplace. Metal goalposts are now virtually universal. Although, since goalposts have been built, the use of aluminum is preferred as it provides resistance to corrosion and is lighter in weight.

Goalposts may be welded together and even put together with tubing and fittings to form a unified product. Frequently, the mechanism for establishing and maintaining the verticality of the uprights involves the use of stainless steel roll pins. These roll pins are inserted through holes in the aluminum tubing used to construct the goalpost, including the uprights. Because stainless steel is much harder than aluminum, the holes through which the roll pins pass become enlarged over time due to the forces experienced by the goalposts. This condition permits the uprights to go out of plumb at a relatively early time in the useful life of the aluminum tubing.

Accordingly, it is an object of the subject invention to provide a goalpost which incorporates a system for adjusting the verticality of the uprights wherein the adjustment is substantially permanent.

It is a further object of this invention to provide a system for supporting and adjusting the verticality of goalpost uprights which is convenient and relatively simple to use during the erection of the goalpost.

SUMMARY OF THE INVENTION

The shortcomings of the prior art are overcome and additional advantages are provided, in one aspect, through the provision of a system in which a rotatable and selectively lockable assembly is provided for supporting and adjusting the verticality of an upright. The rotatable assembly is comprised of a rotatable member disposed within the crossbar of a goalpost and adapted for rotation substantially about the central axis of the crossbar. A stub upon which an upright is mounted is integrally formed with the rotational member and protrudes through an opening in the crossbar sized to permit a predetermined amount of rotational movement of the rotatable assembly. A locking mechanism comprised of a tapping block and a bolt is operatively associated with the crossbar and the rotatable assembly for selectively preventing rotational movement therebetween.

In another aspect, a method is provided for supporting and adjusting the verticality of an upright of a sports goalpost by providing a crossbar formed as a tubular wall around a central axis and having at least one opening in the wall near an end thereof. A rotatable member is disposed within the crossbar at the location of the opening, the rotatable member having a stub which protrudes through the opening in the crossbar. As part of this method, a lock is provided for selectively preventing rotational movement between the rotatable member and stub on the one hand and the crossbar on the other.

In yet another aspect of the invention, a method is provided for assembling a system for adjusting and supporting the verticality of an upright of a goalpost. The method includes the steps of: creating an opening in the tubular wall of a crossbar; forming a sleeve with cutouts therein for receiving a stub; inserting the sleeve through the end of the crossbar so that the cutouts are aligned with the opening in the tubular wall of the crossbar; inserting a stub through the opening in the crossbar and the cutouts in the sleeve; welding the stub to the sleeve at the cutouts so that the axis of the stub is orthogonal to the axis of the sleeve, the opening in the crossbar being dimensioned to permit rotational movement of the sleeve and stub substantially about the axis of the crossbar, but permitting substantially no axial movement of the sleeve and stub; attaching the upright to the sleeve, adjusting the verticality of the upright as desired and then locking the sleeve against further rotational movement about said axis.

BRIEF DESCRIPTION OF THE DRAWINGS

The subject matter which is regarded as the invention is particularly pointed out and distinctly claimed in the claims at the conclusion of the specification. The foregoing and other objects, features and advantages of the invention are apparent from the following detailed description taken in conjunction with the accompanying drawings in which:

BEST MODE FOR CARRYING OUT THE INVENTION

Figure 1:
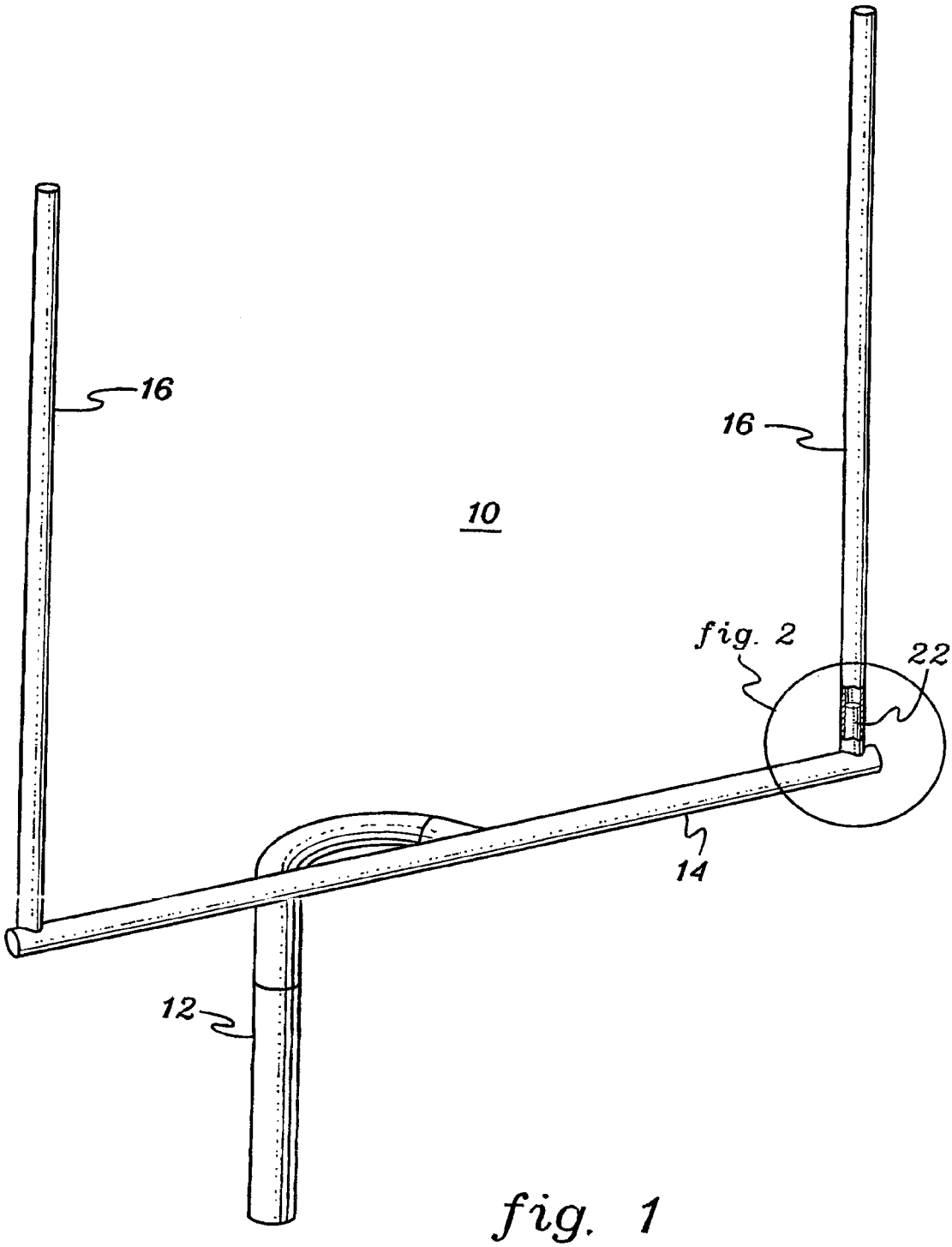
FIG. 1 is a perspective view of a football goalpost incorporating the invention.

FIG. 1 is a perspective view of a football goalpost with parts broken away. Goalpost 10 includes a crossbar 14 and two uprights 16. Crossbar 14 is connected to a gooseneck 12 which, in turn, is mounted in the playing field. As shown on the right side of FIG. 1, upright 16 is mounted on a stub 22, as will be described in more detail below. For clarity in the following discussion, the "front" of goalpost 10 will refer to the side thereof facing the football field. The "back" of the goalpost will refer to that side of the goalpost which faces the end zone of a football field. An adjustment of the upright 16 toward or away from the playing field may be referred to as a "front to back" adjustment. An adjustment of an upright toward or away from the other upright will be referred to as a "side to side" adjustment.

Figure 2:
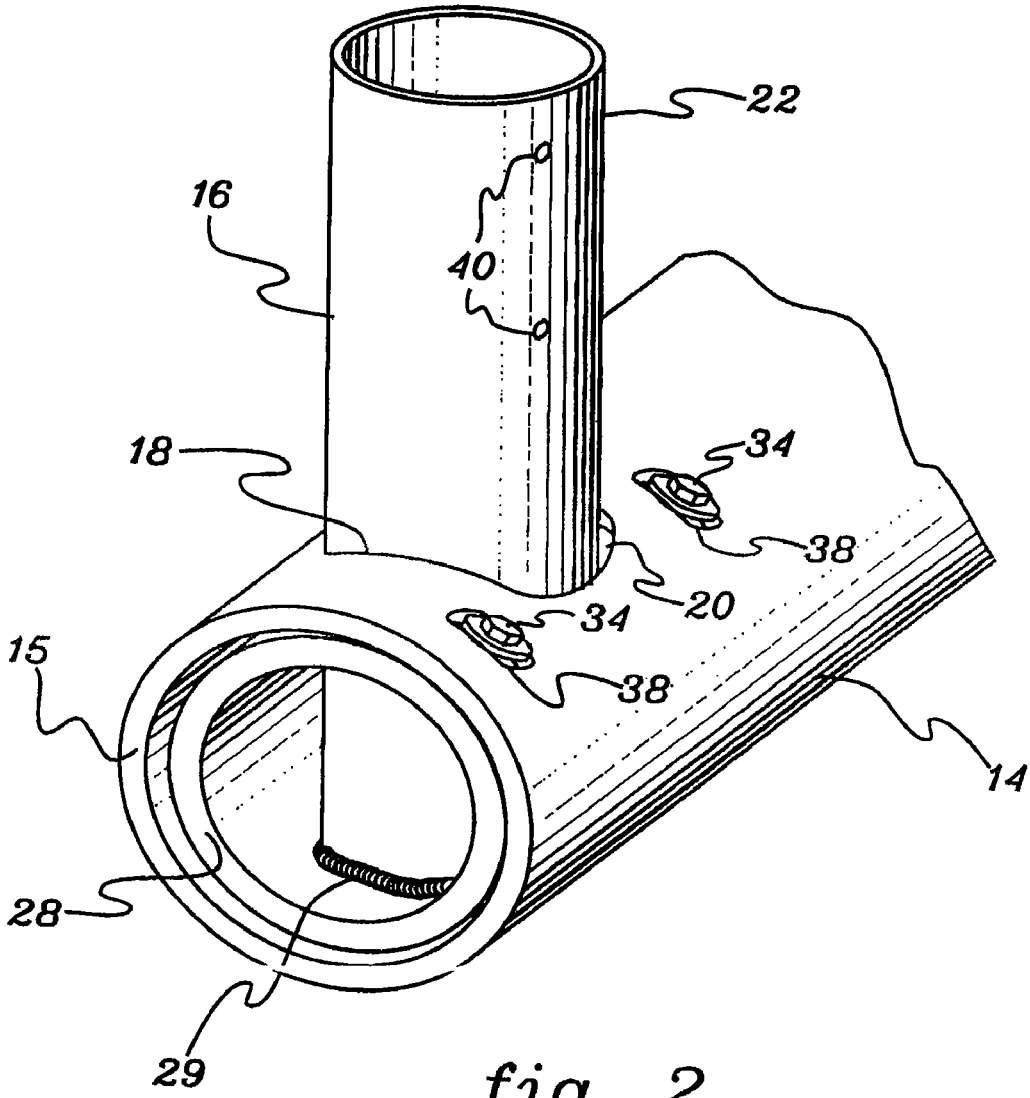
FIG. 2 is an isometric view of the circled portion of FIG. 1 taken from an oblique elevated rearward position with the upright and end cap removed.
Figure 3:
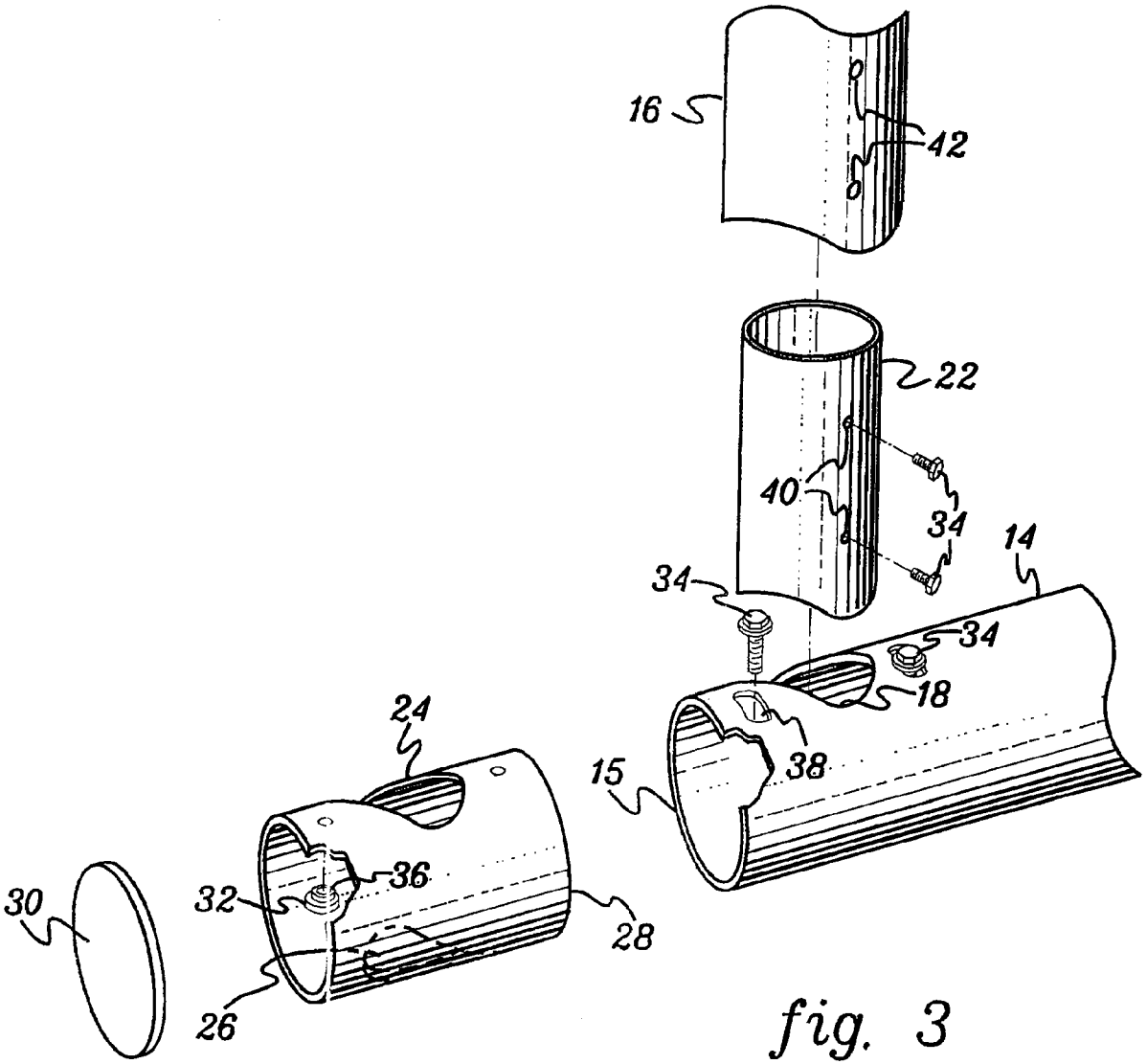
FIG. 3 is an exploded perspective rear view of the components of the invention depicted in FIG. 2.

Referring now to FIGS. 2 and 3, it will be seen that stub 22 passes through an opening 18 adjacent an end 15 of crossbar 14. It also passes through cutouts 24 and 26 in sleeve 28. Cutouts 24 and 26 are dimensioned so as to closely surround stub 22. Stub 22 is welded to sleeve 28 at cutouts 24 and 26, thus integrating stub 22 and sleeve 28. To accomplish this, sleeve 28 is first inserted in crossbar 14 with cutouts 24 and 26 aligned with crossbar opening 18. Next, stub 22 is inserted through opening 18 and cutouts 24 and 26. The welding of stub 22 to sleeve 28 is accomplished by inserting a welding tool through the adjacent end 15 of crossbar 14. Welding material 29 may be seen in FIG. 2. Also, it may be seen from these figures that the outside diameter of sleeve 28 is only slightly less than the inside diameter of crossbar 14. Thus, sleeve 28 is substantially coaxial with crossbar 14. Although the axis of sleeve 28 is drawn slightly off center when sleeve 28 is locked to crossbar 14, as explained below, its axis remains parallel with the axis of crossbar 14.

As best seen in FIG. 2, opening 18 of crossbar 14 is oblong. In other words, opening 18, as would be seen in a top plan view is circular except that its diameter in the direction orthogonal to the axis of the crossbar is elongated. The diameter of oblong opening 18 in the direction parallel to the axis of the crossbar is chosen to be only slightly larger than the outside diameter of stub 22. Thus, stub 22 is prevented from making any significant movement in the direction of the axis of crossbar 14. However, the elongation of the front to back diameter of opening 18 permits stub 22 and sleeve 28 to rotate as a unit about the central axis of crossbar 14. It may be observed that space 20 which results from the oblongness of opening 18 accommodates this front to back or back to front movement. It is this permitted movement which allows the verticality of stub 22 and upright 16 to be adjusted.

Stub 22 is fixed at an angle of substantially 90° to the axis of crossbar 14 when stub 22 is welded to sleeve 28. Thus, once crossbar 14 is leveled and made parallel to the end line of the playing field and sleeve 28 is locked to crossbar 14 as explained below, there is no need for any side to side adjustment of the uprights 16. The leveling of crossbar 14 is accomplished in any suitable manner using fittings and bolts, as is well known to those skilled in the art. Typical fixtures and parts for the leveling of crossbar 14 are illustrated and described in U.S. Pat. No. 7,014,578 to Brodeur, the contents of which are hereby incorporated by reference.

FIG. 3 also shows a pair of locking devices for immobilizing sleeve 28 and stub 22, once stub 22 and its associated upright 16 are in the desired vertical alignment. The locking device is comprised of a tap block 36 and a flanged bolt 34. Tap block 36 is formed with a shoulder 32 and is inserted from the inside of sleeve 28 through a hole (not shown) in sleeve 28 before it is inserted into the end of crossbar 14. The hole in sleeve 28 is sized to engage shoulder 32 when tap block 36 is inserted therein. Tap block 36 is welded to sleeve 28 before sleeve 28 is inserted into crossbar 14. Holes 38, visible in FIG. 2, are provided in crossbar 14 through which flanged bolts 34 may be inserted. As shown in FIG. 2, holes 38 are oblong in a direction orthogonal to the axis of the crossbar. Holes 38 are dimensioned to accommodate the same amount of rotational movement available to stub 22 due to the oblongness of opening 18. Thus, when the desired vertical position of stub 22 and its associated upright 16 have been achieved, flanged bolts 34 can be tightened into tap block 36, thus drawing sleeve 28 tightly against the inside of crossbar 14 and thereby locking it. This locking effect prevents movement, rotational or otherwise, with respect to crossbar 14.

Preferably, tap block 36 is provided with a screw thread insert for added strength. A suitable screw thread insert would be the product sold under the trademark Heli-Coil marketed by E.M. Hart Technologies. Also, the flanged bolt is preferably serrated so that, once it has been tightened against the surface of crossbar 14, it cannot easily become loosened.

As shown in FIG. 3, stub 22 has two holes 40 that are used to secure upright 16 to stub 22. To secure upright 16 to stub 22, a locking system similar or identical to that used to immobilize sleeve 28 is used. Accordingly, this locking system consists of two tap blocks 36 (not visible in FIG. 3) and flanged bolts 34. The size of the hole 40 is such that a shoulder 32 will be engaged when a tap block 36 is inserted in hole 40 from the inside of stub 22. Tap blocks 36 are welded in place inside stub 22 before stub 22 is welded to sleeve 28. Once again, tap blocks 36 are preferably provided with screw thread inserts for added strength. Corresponding holes 42 are made in upright 16 through which serrated flanged bolts 34 may be inserted into tap blocks 36 and tightened. Once again, it is preferable to use a flanged bolt 34 that is serrated so as to ensure that it will not become loosened once it has been tightened against the surface of upright 16.

Preferably, the gooseneck, crossbar, sleeves and uprights of the subject invention are made of aluminum, as are tapping blocks 36. Also preferably, the screw thread inserts and serrated bolts are made of stainless steel. The welds are made of suitable materials for welding aluminum components, as is well known to those skilled in the art. Although only one end of crossbar 14 has been shown in FIGS. 2 and 3, it will be understood that the other end of crossbar 14 and the associated components shown in FIGS. 2 and 3 are the same. It should be noted also that the use of bolts 34 at the rear of upright 16 permits the front side of upright 16 to be smooth and free of protruding bolts. Similarly, holes 38, as shown in FIG. 2 are offset to the rear of crossbar 14 so that there are no protruding bolts on the front side of crossbar 14.

Although embodiments have been depicted and described in detail there, it will be apparent to those skilled in the relevant art that various modifications, additions, substitutions and the like can be made without departing from the spirit of the invention and these are therefore considered to be within the scope of the invention as defined in the following claims.

What is claimed is:

1. A system for supporting and adjusting the verticality of an upright of a sports goalpost comprising:

a crossbar formed as a tubular wall around a central axis and having an opening in said wall;

a rotatable assembly comprised of a rotational member disposed within the crossbar for rotational movement substantially around said axis and a stub adapted to receive the upright, said rotational member comprising a sleeve having a first cutout through which the stub protrudes, said stub being integrally formed with the rotational member and protruding therefrom so as to pass through the opening in the crossbar wall, said opening in said wall of the crossbar being dimensioned to permit a preselected amount of rotational movement of the stub extending through said opening in said wall of the crossbar around the axis of the crossbar and of rotational movement of the rotational member around the axis of the crossbar; and at least one lock operatively associated with the rotational assembly and the crossbar for selectively preventing rotational movement therebetween.

2. The system of claim 1 wherein the sleeve has a second cutout in opposed relationship to the first and wherein the stub is rigidly affixed to the sleeve at each of the cutouts.

3. The system of claim 1 wherein the opening in the wall of the crossbar is oblong and dimensioned so as to substantially prevent axial movement of the stub.

4. The system of claim 1 wherein the lock is comprised of at least one tap block secured to the inside of the sleeve in registration with a first hole through the sleeve adjacent the first cutout and a bolt insertable therein through a second hole in the wall of the crossbar so as to engage the tap block.

5. The system of claim 4 wherein the tap block is provided with a screw thread insert for reception of the bolt and wherein the bolt has a flange.

6. A goalpost comprising a crossbar having a system according to claim 1 at each end thereof.

7. A goalpost comprising a crossbar having a system according to claim 2 at each end thereof.

8. A goalpost comprising a crossbar having a system according to claim 3 at each end thereof.

9. A goalpost comprising a crossbar having a system according to claim 4 at each end thereof.

10. A goalpost comprising a crossbar having a system according to claim 5 at each end thereof.

11. A method of adjusting a sports goalpost, the method comprising:

providing the sports goal post comprising a crossbar, a pair of uprights, and the system according to claim 1 at each end of the crossbar;

adjusting the verticality of the pair of uprights of the sports goal post; and locking the systems relative to the crossbar to maintain the verticality of the pair of uprights.

12. A method of adjusting a sports goalpost, the method comprising:

providing the sports goal post comprising a crossbar, a pair of uprights, and the system according to claim 2 at each end of the crossbar;

adjusting the verticality of the pair of uprights of the sports goal post; and locking the systems relative to the crossbar to maintain the verticality of the pair of uprights.

13. A method of adjusting a sports goalpost, the method comprising:

providing the sports goal post comprising a crossbar, a pair of uprights, and the system according to claim 3 at each end of the crossbar;

adjusting the verticality of the pair of uprights of the sports goal post; and locking the systems relative to the crossbar to maintain the verticality of the pair of uprights.

14. A method of adjusting a sports goalpost, the method comprising:

providing the sports goal post comprising a crossbar, a pair of uprights, and the system according to claim 4 at each end of the crossbar;

adjusting the verticality of the pair of uprights of the sports goal post; and locking the systems relative to the crossbar to maintain the verticality of the pair of uprights.

* * * * *